US005817198A

United States Patent [19]

Viertola

[11] Patent Number: 5,817,198

[45] Date of Patent: Oct. 6, 1998

[54] LINING METHOD AND SYSTEM FOR HIGH TEMPERATURE SPACES

[76] Inventor: Raimo Viertola, Polunmäenkatu 40, FIN-33720 Tampere, Finland

[21] Appl. No.: 648,093

[22] PCT Filed: Nov. 18, 1994

[86] PCT No.: PCT/FI94/00520

§ 371 Date: Aug. 15, 1996

§ 102(e) Date: Aug. 15, 1996

[87] PCT Pub. No.: WO95/14203

PCT Pub. Date: May 26, 1995

[30] Foreign Application Priority Data

Nov. 19, 1993 [FI] Finland ..... 935156

[51] Int. Cl.[6] ..... F27D 1/00

[52] U.S. Cl. ..... 156/71; 52/506.03; 110/336; 206/321; 206/459.5

[58] Field of Search ..... 156/71; 264/30; 110/336; 432/247, 251; 52/506.02; 206/321, 449, 459.5

[56] References Cited

U.S. PATENT DOCUMENTS

| | | | |
|---|---|---|---|
| 3,993,237 | 11/1976 | Sauder | 156/71 |
| 4,177,036 | 12/1979 | Sauder | 110/336 |
| 4,324,602 | 4/1982 | Davis et al. | 156/71 |
| 4,344,753 | 8/1982 | Shelley | 110/336 |
| 4,440,099 | 4/1984 | Brachet | 110/336 |
| 4,443,509 | 4/1984 | Sauder | 156/71 |
| 4,955,809 | 9/1990 | Viertola | 432/247 |
| 5,353,567 | 10/1994 | Knight | 52/506.03 |

FOREIGN PATENT DOCUMENTS

| | | |
|---|---|---|
| 2503854 | 10/1982 | France . |
| 2832079 | 12/1979 | Germany . |
| 2952532 | 6/1981 | Germany . |
| 3447800 | 7/1986 | Germany . |
| 1592611 | 7/1981 | United Kingdom . |
| 92/19926 | 11/1992 | WIPO . |

*Primary Examiner*—Daniel Stemmer
*Attorney, Agent, or Firm*—Andrus, Sceales, Starke & Sawall

[57] ABSTRACT

A procedure for lining spaces with high temperatures, in which the surfaces of the space are lined with fibrous lining material in which the fibers are mainly parallel with planes at right angles against the surface of the space. In the procedure, loose, separate, plate-like fiber strips (1) are used which are disposed side-by-side relative to each other in an installation position to form a transport/application package (2). A fixing compound (3) is applied as a layer upon the edges of the side-by-side strips advantageously over the whole area of one strip layer (4) of the transport/application package. From the package is taken a suitable bunch of strips treated with fixing compound, this bunch being pressed onto the surface of the space at the point of installation and compressed to suitable compactness. The whole surface to be treated is lined, one bunch at a time with fiber strips treated with fixing compound, the bunches being of suitable size depending on the size and shape of the object of installation.

14 Claims, 4 Drawing Sheets

LINING METHOD AND SYSTEM FOR HIGH TEMPERATURE SPACES

BACKGROUND OF THE INVENTION

The present invention concerns a procedure for lining spaces with high temperatures and a system for lining spaces with high temperatures.

The state of art in the field of the present invention in presented in the Finnish Patent 86668 and in the published applications DE 2709958 and DE 3533982. The procedures and systems of prior art are based on various modules and elements of standard size, which are suitably cemented, or in any other way attached, to the surface being lined. Since the surfaces which are lined are of greatly varying shapes in individual instances, one is invariably compelled to cut and shape the elements and modules. The manufacturing costs of different elements and modules are also rather high, particularly when they have to be produced in different sizes and shapes to suit different applications. Furthermore, the prior art suffers from the drawback of inconvenient repairability and serviceability of the structures because the entire element or module has to be replaced if part of it is damaged.

SUMMARY OF THE INVENTION

The object of the intention is to eliminate the drawbacks mentioned above. Specifically, the object of the invention is to disclose a novel procedure and system for lining spaces with high temperatures by the aid of which the lining work is fast, flexible and simple, independent of the dimensions and shapes of the surface which is being lined, in which the material cost is substantially lower than in prior art, and in which the repair and service operations are simple and easy to implement.

Regarding the features characterizing the invention, reference is made to the claims section.

In the procedure for lining spaces with high temperatures of the invention the most essential feature is that no solid, large fiber strip bunches or other elements are used, but instead loose, separate and plate-like fiber strips are used, which are disposed side by side with reference to each other in installation position to form a transport/application package. This enables the fixing compound to be applied as a layer on the edges of mutually adjacent fiber strips, advantageously in one run on the whole area of one fiber layer in the transport/application package, whereby it becomes possible to take of the fibers treated with fixing compound in each case an appropriate bunch of required size, which is pressed to adherence to the surface of the space at the point of installation and pressed down to desired compactness. In this way, in the procedure of the invention, depending on size and shape of the object of installation, from the transport/application package is in each instance taken a bunch of suitable size of the fiber strips treated with fixing compound and these are pressed onto the surface to be lined, at the desired point.

The system of the invention comprises transport/application packages of fibrous lining material strips in which the loose and separate fiber strips are packed tightly side by side to constitute a top surface of the package which is coherent of its edges and level, this surface constituting the mating surface for the space to be processed by lining. Hereby, application of the fixing compound on the top surface of the package enables the strips to be taken from the package in suitable batches, of freely selectable size, and lifted out and affixed to the surface of the space to be treated which has to be lined.

It is thus understood that in the procedure and system of the invention the transport/application packages are conveyed directly to the mounting site, where they are opened and cementing mortar or equivalent fixing agent is applied directly on the edge surface of the fiber strips in the package, the treated fiber strips being affixed in suitable bunches directly to the object of installation.

The procedure and system of the invention enable a highly flexible and fast lining process in which the need of cutting and shaping the lining material at the site of installation has been minimized. Furthermore, repair and servicing operations are simple in the system because large elements or modules need never be removed from the lined surfaces: it is merely necessary to remove any damaged strips and to replace them. In comparison with techniques of prior art, the procedure and system of the invention are appropriate, owing to their versatility and flexibility, to be applied in all applications: it reacts elastically to thermal expansion and suffers no heat damage, its mechanical strength both in contact and in gas flows is good, the convenience, fastness and ease from the professional viewpoint of its installation are in a class of their own, it requires no special tools and it is moreover competitive as to its price.

BRIEF DESCRIPTION OF THE DRAWING

The other advantages and various practical applications of the invention will become apparent from the following description, in which the invention is described in detail, referring to the attached drawings, wherein.

DETAILED DESCRIPTION OF THE PREFERRED EMBODIMENTS

Figure 1:
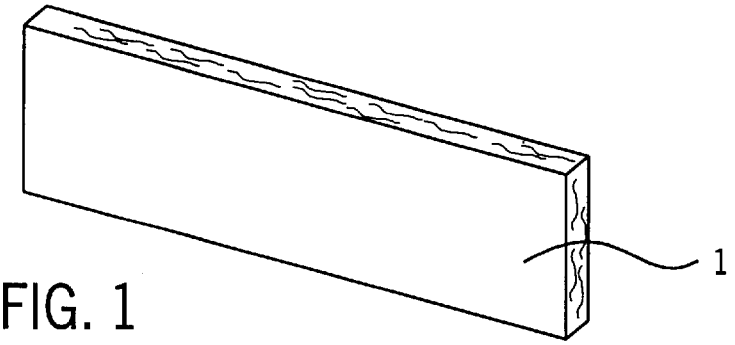
FIG. 1 presents a fiber strip such as is used in the invention.

FIG. 1 depicts the basic element used in the invention, i.e., one fiber strip 1 which is a body with the form of a rectangular parallelepipedon of e.g. 300, 450 or 600 mm length, 50 or 100 mm height and 10, 15 or 20 mm breadth consisting of fibrous insulating material, appropriate in each particular case.

Figure 2:
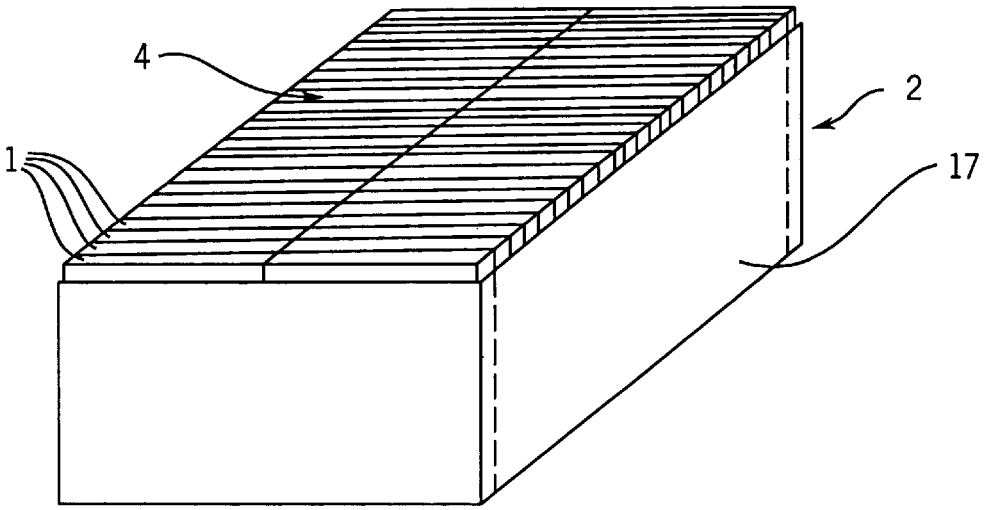
FIG. 2 presents the transport/application package of the invention.
Figure 3:
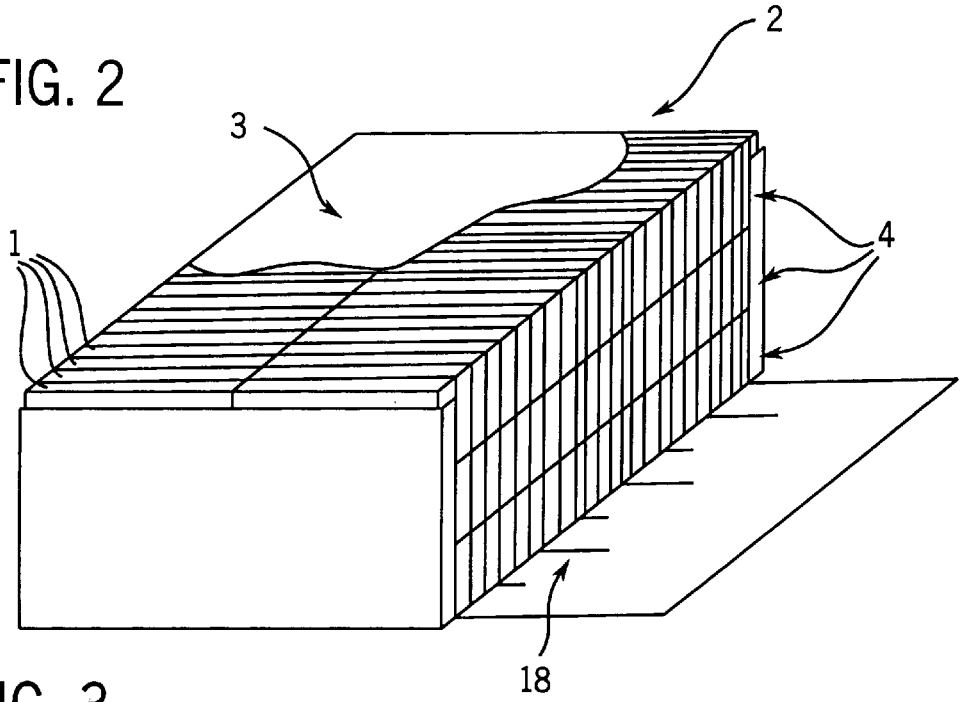
FIG. 3 shows the transport/application package of FIG. 2 in use.

As depicted in FIGS. 2 and 3, the fiber strips 1 are packed to form a transport/application package 2 in which the fiber strips, packed tightly side by side, form uniform fiber strip layers 4. The package may contain one or several courses, such as three courses in the embodiment of the figure. Advantageously, when the package comprises several fiber strip courses, at least one side 17 of the package can be opened so that at least one edge of the strip courses is exposed. Furthermore, advantageously, on the package have been provided dimensional markings 18, by the aid of which it is easy to take from the package fiber strip bunches of a given size, without separate measurement.

As can be seen in FIG. 3, the fiber strip packages 2 are used by opening the package at least on the top side and by applying, at the immediate site of installation, on the top surface of the package a suitable fixing compound 3, advantageously over the entire top surface of the package, or over the topmost fiber strip course. Hereafter the top layer can be used by taking from it a fiber strip bunch of proper size in each instance and this can be pressed onto the surface which is being lined, at the desired point and in desired position. It is thus obvious that In the procedure and system of the invention no separate mounting tables or premises are required for material cutting or fixing compound handling: minor cutting operations that may be required, or shaping of the fibers, can be carried out in the fiber strip packing or not until at the place of installation, all wasting of material remaining minimal.

Figure 4:
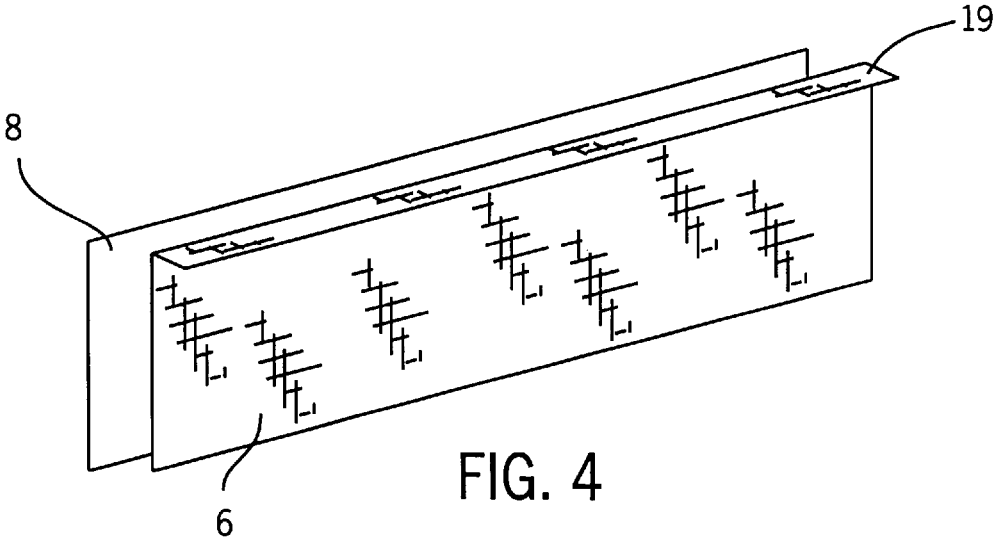
FIG. 4 shows the base element used in the invention, FIG. 5 shot the use of the base element of FIG. 4.

In FIG. 4 is depicted a net-like base element 6, which can be used as mounting base for the fiber strips when the fibers cannot be attached directly to the surface which is being lined. In that case a base element 6, consisting of metal netting and having on its upper margin a perpendicular reinforcing flange 19 extending over its entire length, is affixed in any suitable way, e.g. by welding or bolting, to the basic structure, and the fiber strips are fixed upon the net.

Figure 5:
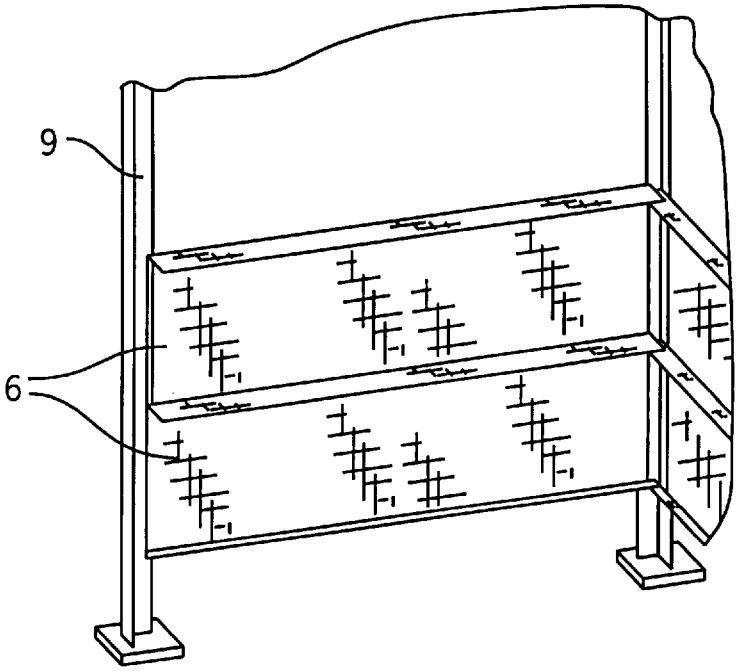

It is equally conceivable that on the rear face of the base element 6 is attached a steel plate 8, which can then be welded to a suitable framework 9, as in FIG. 5. The steel plate will thus constitute the outer wall of the space that is being lined.

Figure 6:
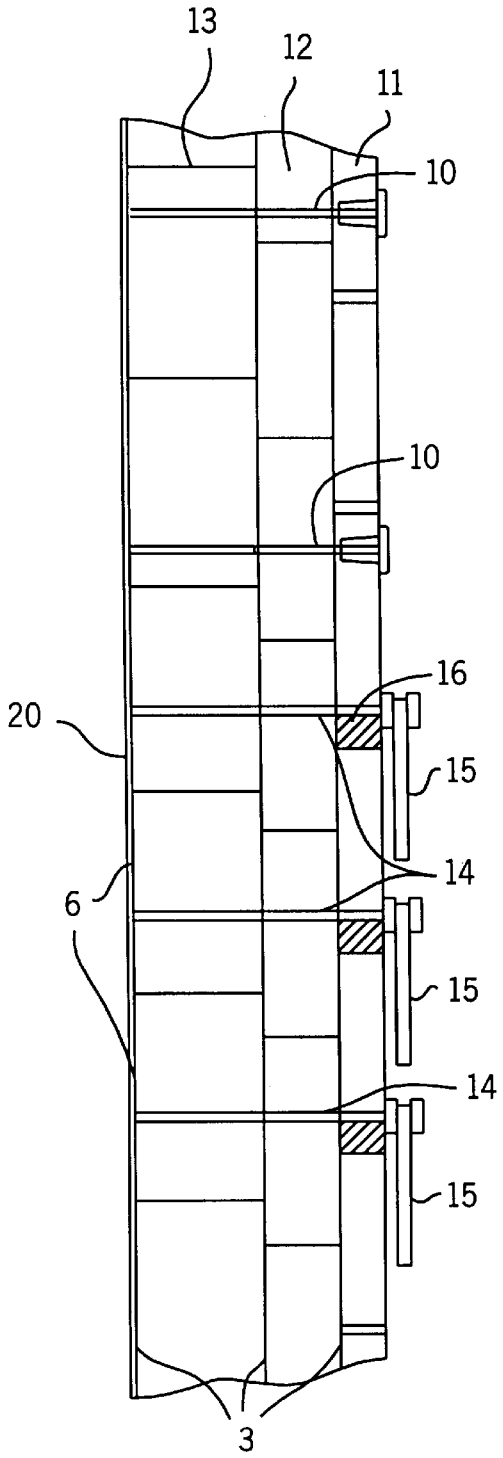
FIG. 6 presents a sectional view of a lining construction according to the invention.

In FIG. 6 is depicted a lining construction according to the invention, wherein to the inner surface 20 of the space to be lined have first been attached plate-like base elements 6. To these elements has with a suitable fixing compound 3 been fixed a first fiber strip course 13, with the fibers substantially parallelling planes which are at right angles against the surface which is being lined. This first course 13 is comparatively thick and its heat resistance may be comparatively low. Upon the first course has been fixed with fixing compound 3 a second, somewhat thinner fiber strip course 12, which has higher resistance to heat than the first course, and upon this course is fixed a third fiber strip course 11, so selected as to its properties that it will withstand even the highest temperatures occurring in the space which is being lined.

In addition, mechanical auxiliary fixing members 10 have been provided in the insulation structure and fixed to the base element 6, these members extending through all three insulating layers and ensuring adherence of the insulating layers to the base element, The construction also includes supports 14 extending through the insulating layer, from which e.g. electrical resistances 15 can be suspended. Advantageously, the supports rest on stays 16 consisting e.g. of refractory bricks, carried by the outermost insulating layer 11. This prevents the supports 14 from subsiding under the weight of the electrical resistances 15 and damaging the insulating material.

Figure 7:
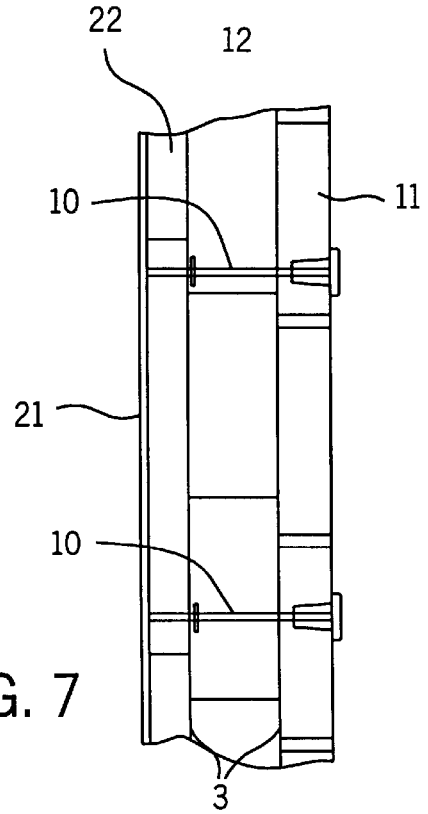
FIG. 7 presents a sectional view of another lining construction according to the invention.

In FIG. 7 is depicted another insulating structure according to the invention, wherein to the inner surface 21 of the space to be treated has first been attached a conventional mineral wool layer 22, and thereupon, two layers 11 and 12 of different thickness, which are fiber strip insulating courses according to the invention. This structure, too, comprises mechanical auxiliary fixing members 10 extending through the whole insulation thickness, by which the insulating materials are braced to the supporting structure of the space which is being lined.

Figure 8:
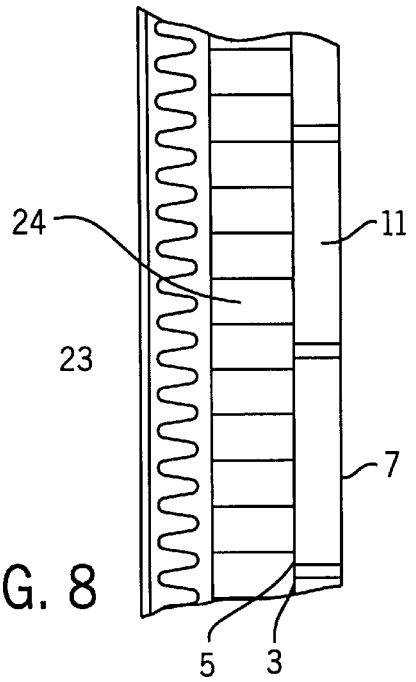
FIG. 8 presents a sectional view of a third lining construction according to the invention.

FIG. 8 depicts a third lining structure according to the invention, in which on the surface to be lined has first been installed a mineral wool layer 23, and upon this has been built a brick cladding 24 of refractory bricks. To this brick surface has been attached with fixing compound 3, for topmost insulating layer 11, a fiber strip course according to the invention. The fiber strip course has furthermore been coated with a surface layer 7, consisting of suitable refractory compound.

Figure 9:
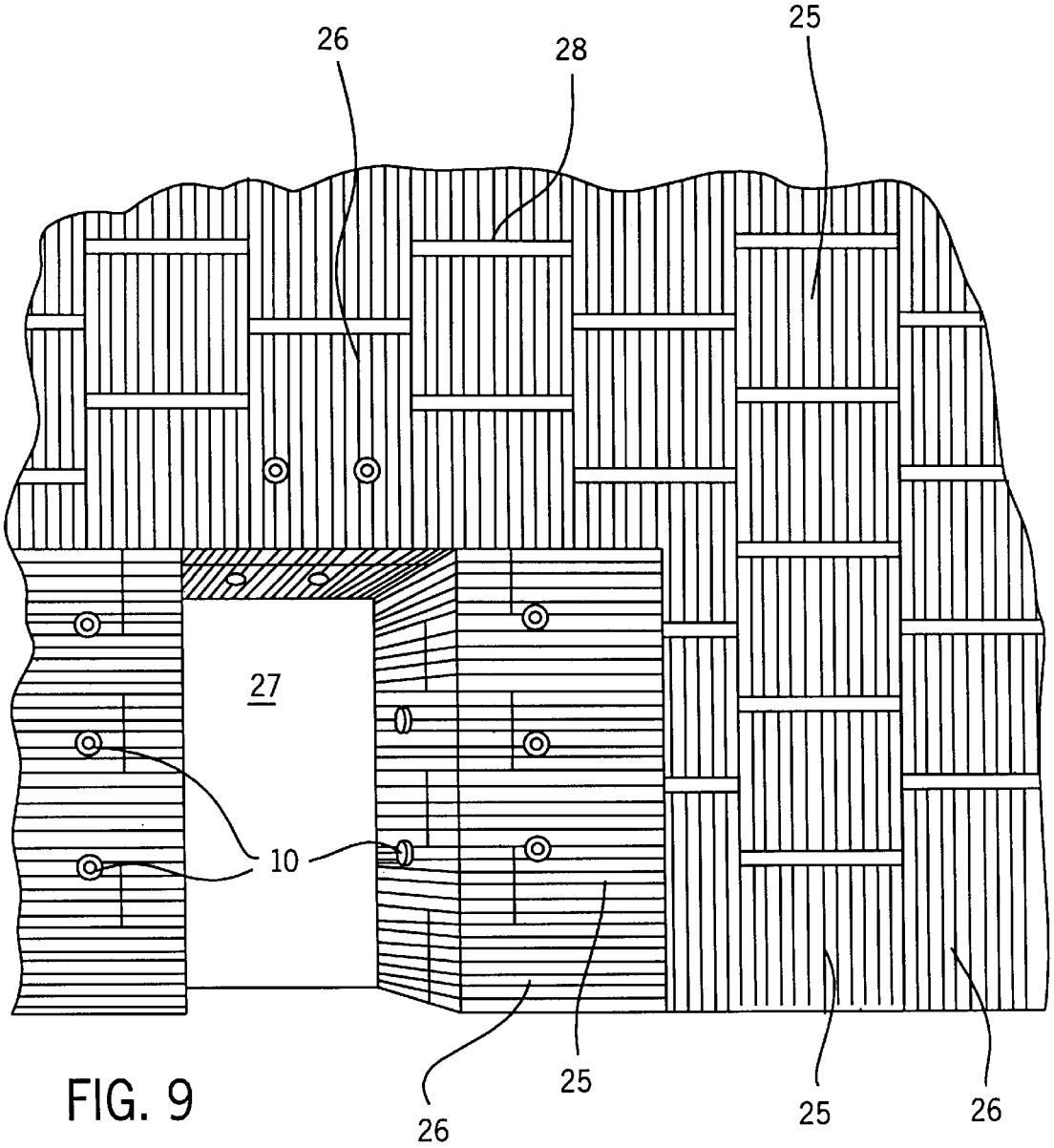
FIG. 9 shows a finished surface lined as taught by the invention.

In FIG. 9 is presented a finished lining construction implemented as taught by the invention, wherein the lining of a varying and multi-formed surface has been implemented using fiber strips of only two different lengths but of the same thickness and breadth. In this embodiment the first fiber strips 25 are e.g. 300 mm in length and the other type of fiber strips 26 is 50% longer, i.e., 450 mm.

In this embodiment around the aperture 27, short and long fiber strips have been used alternatingly one bunch at a time, so that the borders around the aperture become linked in a tight corner joint. Moreover, mechanical auxiliary fixing members 10 have been used in the marginal areas around the aperture, by which retention in their place of the insulating layers has been ensured. On the smooth wall surface the shorter fiber strip length has mainly been used, every time one bunch of strips with a breadth equalling the length of the fiber strip being fixed to the surface which is being lined, and thereafter one strip 28 transversel to the strips in the bunch being mounted on the end of the strip bunch, this strip 28 serving to seal and straighten the package constituted by the strips, and to equalize the thermal movements in the structure.

Figure 10:
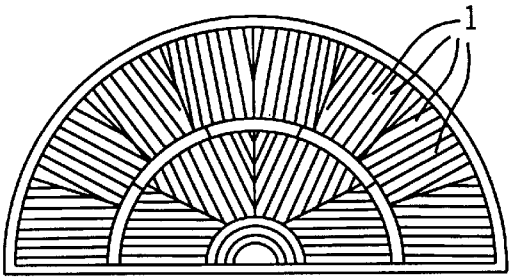
FIG. 10 shows another finished surface lined as taught by the invention.

In FIG. 10 is presented a structural design according to the invention for insulating round-shaped surfaces. Since the individual, and separate, fiber strips are comparatively small, even a round-shaped surface can be lined for the greater part with whole fiber strips, while a minor part only have to be carved and cut off in order to fill every cavity.

In the foregoing the invention has been described by way of example with the aid of the attached drawing, while various embodiments of the invention are feasible within the scope of the inventive idea delimited by the claims.

I claim:

1. A process for lining a surface defining a space in which high temperatures are present, said method comprising the steps of:

forming a plurality of plate-shaped, fiber batts (1) suitable for comprising incremental portions of the surface lining, each of the batts having a pair of spaced side surfaces with edge surfaces extending between said side surfaces around the perimeter of the batt, the fibers of the batt lying generally parallel to the side surfaces of the batt;

arranging pluralities of the fiber batts to form parallelepipedal transport/application packages (2), the batts of each package being arranged and retained in side-by-side relation with the side surfaces of the batts abutting to form at least one row of batts;

applying a fixing compound (3) to a package of batts, the fixing compound being applied to the exposed edge surfaces of the batts lying in one of the exterior planes of the parallelepipedal transport/application package;

dividing and removing from a package a portion of the row of batts, said portion comprising a plurality of contiguous batts the number of which is selected in accordance with the configuration of a portion of the surface to be lined;

pressing the edge surfaces of the removed batts containing the fixing compound on the portion of the surface being lined to adhere the batts to the portion of the surface being lined with the side surfaces of the batts positioned at generally right angles to the surface being lined, the removed batts forming incremental portions of the surface lining; and repeating the applying and pressing steps, as well as the dividing and removing steps as required, until the surface is lined with the plate-shaped fiber batts.

2. The process according to claim 1 wherein the removed batts are adhered directly to the surface being lined by the fixing compound.

3. The process according to claim 1 further including the step of placing a base sheet in the form of a net (6) adjacent the edge surfaces of the batts to which the fixing compound is applied and along the surface being lined, and wherein the pressing step is further defined as pressing the surfaces of the removed batts containing the fixing compound on the base sheet.

4. The process according to claim 1 wherein the step of applying the fixing compound is further defined as applying a fixing compound to the entirety of said exposed surfaces in said one exterior plane.

5. The process according to claim 1 wherein the arranging step is further defined as arranging the plurality of fiber batts to form parallelepipedal transport/application packages having a plurality of adjacent rows of batts.

6. The process according to claim 5 wherein the arranging step is further defined as arranging the rows of batts to form side-by-side rows of batts.

7. The process according to claim 5 wherein the arranging step is further defined as arranging the batts to form a stack of rows of batts.

8. The process according to claim 6 wherein the arranging step is further defined as arranging the batts to form a stack of side-by-side rows of batts.

9. The process according to claim 1 further including the step of placing a wrapper around a plurality of batts to retain the batts in a transport/application package.

10. The process according to claim 1 wherein the pressing step is further defined as compressing the removed batts to a desired degree of compactness.

11. The process according to claim 1 wherein the lining of batts formed by the steps of the process comprises a first layer of fiber batts and wherein the process includes the further steps of dividing and removing from a transport/application package a portion of a row of batts comprising a plurality of contiguous batts the number of which is selected in accordance with the configuration of a portion of an exposed surface of the first layer of batts, and pressing the surfaces of the removed batts containing the fixing compound on the portion of the exposed surface of the first layer of batts to adhere the batts to the exposed surface of the first layer of batts, and repeating the applying and pressing steps, as well as the dividing and removing steps as required, until the exposed surface of the first layer of batts is lined with a second layer of plate-shaped fiber batts.

12. The process according to claim 1 further including the step of applying a protective face layer (7) to exposed surfaces of the plate-shaped fiber batts forming the surface lining.

13. The process according to claim 11 further defined as including the step of providing a protective facing layer to exposed surfaces of said second layer of plate-shaped fiber batts.

14. An article of manufacture for use in lining a surface defining a space in which high temperatures are present, said article of manufacture comprising:

a plurality of plate-shaped, fiber batts (1) suitable for comprising incremental portions of the surface lining, each of the batts having a pair of spaced side surfaces with edge surfaces extending between said side surfaces around the perimeter of the batt, the fibers of the batt lying generally parallel to the side surfaces of the batt;

a plurality of said fiber batts being arranged to form a parallelepipedal transport/application unit, the batts of said unit being arranged in side-by-side relation with the side surfaces of the batts abutting to form at least one row of batts having an axis extending normal to said abutting side surfaces; and a wrapper surrounding a plurality of the exposed surfaces of said parallelepipedal transport/application unit to form a transport/application package, said wrapper having a portion lying on a surface of said transport/application package that lies parallel to said axis, said portion being openable to expose edge surfaces of said batts and to facilitate removal of a portion of a row formed of a contiguous plurality of batts from the package, said portion of said wrapper having dimensional markings spaced in a direction parallel to said axis and visible when said portion is open to assist in determining the size of the portion of the row of batts to be removed from the package.

* * * * *